US005791874A

United States Patent [19]

Lang

[11] Patent Number: 5,791,874

[45] Date of Patent: Aug. 11, 1998

[54] MARINE PROPELLER WITH ADJUSTABLE CUPPING

[75] Inventor: William P. Lang, Oshkosh, Wis.

[73] Assignee: Brunswick Corporation, Lake Forest, Ill.

[21] Appl. No.: 786,870

[22] Filed: Jan. 23, 1997

[51] Int. Cl.[6] ..... B63H 1/26

[52] U.S. Cl. ..... 416/62; 416/146 R; 416/224; 416/235; 29/889.1

[58] Field of Search ..... 416/62, 93 A, 416/146 R, 197 R, 197 A, 224, 235, 236 R, 237, 238; 29/889.1, 889.6; 440/49; 403/381

[56] References Cited

U.S. PATENT DOCUMENTS

| | | | |
|---|---|---|---|
| 4,802,822 | 2/1989 | Gilgenbach et al. . | |
| 4,865,520 | 9/1989 | Hetzel et al. . | |
| 5,158,433 | 10/1992 | Cleary . | |
| 5,328,329 | 7/1994 | Monroe | 416/62 |
| 5,351,395 | 10/1994 | Crawmer et al. | 416/224 |

FOREIGN PATENT DOCUMENTS

| | | | |
|---|---|---|---|
| 0071689 | 6/1981 | Japan | 29/889.6 |
| 0215905 | 12/1984 | Japan | 416/224 |
| 0496700 | 12/1938 | United Kingdom | 416/62 |

OTHER PUBLICATIONS

"Everything You Need To Know About Propellers", pp. 6–8, 4th Ed., Brunswick Corp., P/N 90–861244–92, 1992.

*Primary Examiner*—Christopher Verdier
*Attorney, Agent, or Firm*—Andrus, Sceales, Starke & Sawall

[57] ABSTRACT

A marine propeller including a hub rotatable about a longitudinal axis and having a plurality of blades extending outwardly from the hub. Each of the propeller blades includes a fixed propeller blade stem and a removable cup extension. The cup extension defines the trailing edge of each propeller blade and is removably mounted to the propeller blade stem. The cup extensions can selectively be removed from the blade stems and new cup extensions attached in order to modify the amount of cupping included on the propeller.

8 Claims, 1 Drawing Sheet

MARINE PROPELLER WITH ADJUSTABLE CUPPING

BACKGROUND OF THE INVENTION

The invention relates to a propeller for a marine propulsion system. More specifically, the invention relates to a marine propeller in which a portion of each propeller blade is removable to vary the amount of cupping contained on the propeller blade.

Propeller blade configurations have a large impact on the operation and efficiency of a marine propulsion system. One of the most important design characteristics of a given propeller is the propeller blade pitch. Propeller blade pitch is defined as the distance that a propeller would move in one complete revolution if it were traveling through a soft solid, in a similar manner to a screw in wood as in, "Everything You Need To Know About Propellers", 4th. edition, Mercury Marine Division of Brunswick Corporation, Catalog QS5-384-10M, Part No. 90-86144, Page 6. The higher the pitch, the more axial movement of the propeller per revolution. For example, a propeller with a 21-inch blade pitch would move forward 21 inches in one revolution, whereas a propeller with a 10 inch blade pitch would move forward 10 inches in one revolution, and so on. Optimum pitch for a propeller is determined by various factors, including load, speed, and boat type. For example, when propelling a boat from rest and when moving a heavy load, such as towing a water skier, a low pitch propeller should be selected. On the other hand, if higher top end speeds are desired, a high pitch propeller should be selected. In the majority of marine propulsion systems, a single pitch propeller is used, and the pitch is selected as a tradeoff between the above noted opposing factors.

There are two common types of pitch; constant pitch and progressive pitch. Constant pitch signifies that the pitch of the propeller is the same at all points from the leading edge of the propeller blade to the trailing edge of the propeller blade. Progressive pitch (also called "blade camber") starts low at the leading edge of the propeller blade and progressively increases to the trailing edge. The pitch number assigned to a propeller having progressive pitch is the average pitch over the entire propeller blade. Progressive pitch improves engine performance when the forward boat speed and the engine RPMs are high and/or when the propeller is operating high enough to break the water surface.

Pitch acts like another set of gears for an engine. For a given engine that is designated to run at an optimal RPM speed, in order to increase the boat speed, the pitch of the propeller must be increased. If too low a pitch propeller is selected, the engine RPMs will run too high, putting an undesirable stress on many moving parts of the engine. While a low pitch propeller will increase the boat acceleration, the top speed of the boat and the propeller efficiency will suffer. If too high a pitch propeller is selected, the engine will lug at low RPMs, which can be very damaging to the marine engine.

One method of increasing the pitch of a propeller is to include a cup portion along the positive pressure surface of the propeller blade near its trailing edge. Adding a cup to the propeller blade results in many of the benefits described for progressive pitch, namely improved performance at high speeds and/or when the propeller is operated high enough to break the water surface. A cup is formed on a propeller when the trailing edge of the propeller blade is formed or cast with an edge that curls away from the boat. Since the benefits resulting from the addition of cupping are so desirable, nearly all modern recreational, high performance, and racing propellers contain some degree of cup. As an illustrative example, cupping can maintain the same boat speed while reducing the full throttle engine speed by about 150–300 RPM below that of the same pitch propeller with no cup. For a cup to be the most effective, it should be completely concave (on the face or pressure side of the blade) and finish with a sharp trailing edge. Any convex rounding of the trailing edge of the cup on the pressure side, such as wear resulting from contacting obstacles in the water, detracts from the propeller's effectiveness.

A propeller is typically cast with a specific amount of cupping contained on its trailing edge. After the propeller has been cast, a propeller technician can somewhat increase or decrease the amount of cup contained on the propeller to alter engine RPM characteristics to meet specific operating requirements. The propeller technician adjusts the amount of cup on a propeller by sanding or physically hammering on the trailing edge of the propeller blade to either increase or decrease the amount of cup. As can be easily understood, this method of increasing or decreasing the amount of cup on a propeller blade is rather imprecise and potentially damaging to the propeller. Therefore, it can be appreciated that a marine propeller in which the amount of cup can be easily and accurately adjusted after the propeller has been cast in order to modify the propeller performance characteristics would be desirable.

SUMMARY OF THE INVENTION

The invention is a propeller for a marine propulsion system which can be configured to include a varying amount of cupping along the trailing edge of the propeller blades. The invention, therefore, allows the boat user to optimally configure a propeller based on a variety of boat operating parameters. A propeller in accordance with the invention includes a propeller hub that is rotatable about an axis of rotation and a series of blade stems extending axially outward from the propeller hub. Each of the blade stems defines the leading edge of the propeller blade and a blade tip. Each of the blade stems includes an aft mounting edge spaced rearwardly from the leading edge.

In accordance with the invention, the propeller includes a plurality of cup extensions which are each removably attached to one of the blade stems. Each of the cup extensions has a leading connecting edge. The connecting edge of each cup extension is engaged by the mounting edge of one of the blade stems, such that the cup extensions are removably attachable to the blade stems. When the cup extensions are attached to the blade stems, the cup extensions define the trailing edge of each propeller blade.

In a preferred embodiment of the invention, the cup extensions are secured to the blade stem by a screw connector that passes through the cup extension and is received by the propeller hub. Removal of the screw connectors allow the cup extensions to be removed from the blade stems.

The propeller constructed in accordance with the invention includes a propeller hub and a series of blade stems which are integrally formed with one another. After formation, a cup extension is attached to each of the blade stems. The cup extensions are selected based on the amount of cupping desired for the particular propeller configuration. In this manner, the amount of cupping on the propeller can be easily varied.

In another feature of the invention, the cup extensions can be formed of a material dissimilar to the blade stems and the propeller hub. In this manner, a propeller constructed in accordance with the invention can be selectively modified based on particular design characteristics.

Other objects and advantages of the invention may appear in the course of the following description.

DETAILED DESCRIPTION OF THE SEVERAL VIEWS OF THE DRAWINGS

The drawings illustrate the best mode presently contemplated of carrying out the invention.

DETAILED DESCRIPTION OF THE INVENTION

Figure 1:
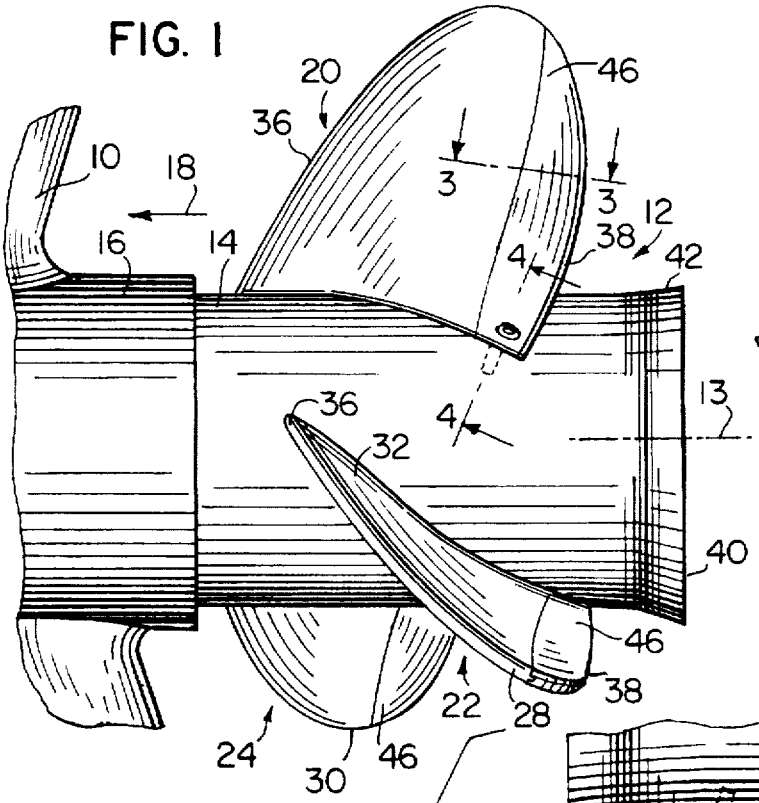
FIG. 1 is a side elevation view of a portion of a marine lower drive unit incorporating a propeller constructed in accordance with the invention.

FIG. 1 shows a marine lower drive unit 10 having a propeller constructed in accordance with the invention and generally referred to at 12 and rotational about rotation axis 13 for forward propulsion therealong, which is leftwardly in FIG. 1. Propeller 12 has a hub 14 that is mounted to a propeller shaft (not shown) extending from the torpedo housing 16 along axis 13. Propeller 12 is a right hand rotation propeller such that when viewed from behind the boat, the propeller 12 rotates in a clockwise direction to propel the boat in a forward direction, as indicated by arrow 18. Propeller hub 14 has a plurality of propeller blades 20,22 and 24 extending generally radially outward therefrom to respective outer blade tips 26,28 and 30. Although propeller 12 has been shown as including three blades, other numbers of blades are possible while operating under the scope of the invention, including for example a four-blade propeller.

Blades 20–24 are identical and blade 20 will now be described in detail with the following description being applicable to each of the blades. Each of the blades has a positive pressure surface 32 facing the aft end of the boat, a negative pressure surface 34 facing the fore end of the boat, a leading edge 36, and a trailing edge 38. These terms are used according to their normal usage and understanding in the art, and for which further reference may be had to the above-noted "Everything You Need To Know About Propellers", Mercury Marine. As the propeller 12 rotates in a clockwise direction when viewed from behind, water is pushed rearwardly, which is rightwardly in FIG. 1, resulting in positive pressure along blade surface 32. At the same time, water is being drawn to surface 34 of each blade, resulting in a negative pressure thereupon. The noted action occurs on all blades which are at least partially submerged as the propeller 12 rotates. Negative pressure pulls the propeller 12 along, while positive pressure pushes it along.

The propeller hub 14 is a generally hollow structure which permits the flow of exhaust from the lower drive unit 10 to exit through its aft end 40. In the preferred embodiment of the invention, the aft end 40 includes a flared diffuser ring 42 which aids in preventing cavitation as is well known.

Figure 2:
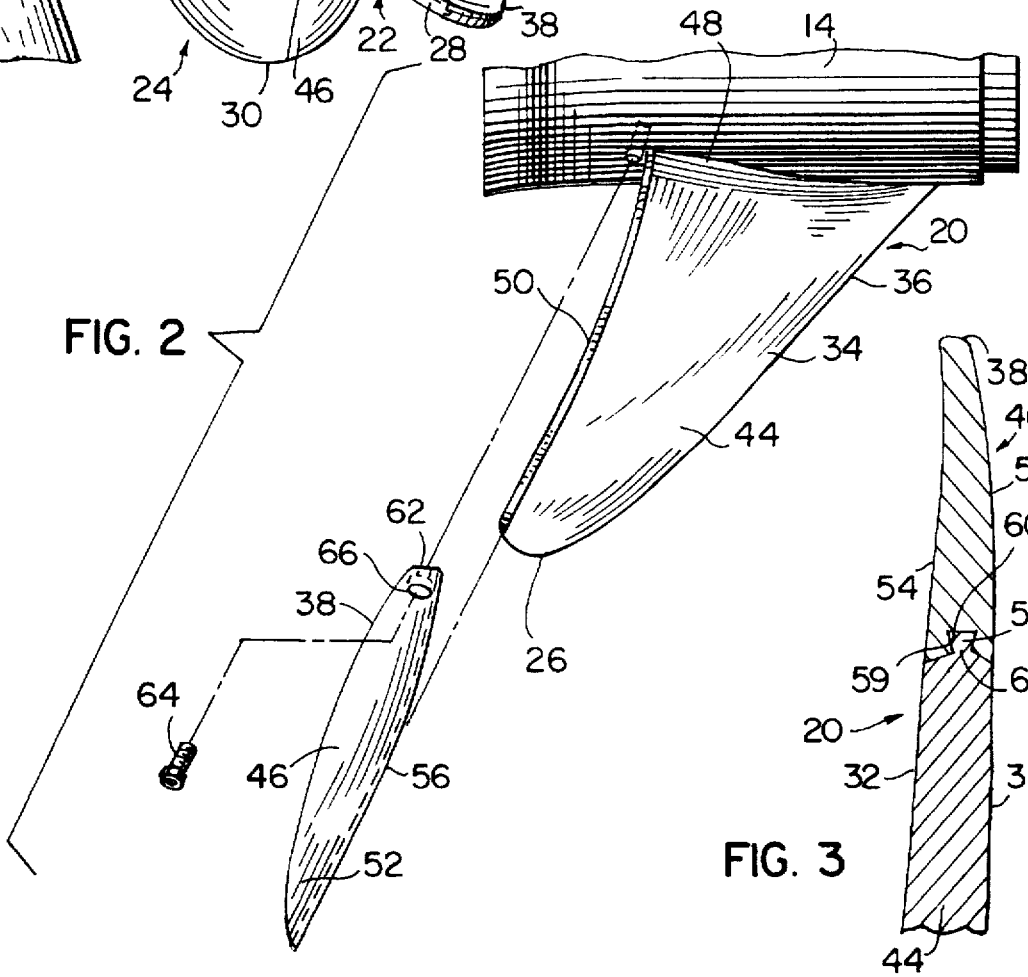
FIG. 2 is a exploded view of the propeller blade and trailing edge cup extension in accordance with the invention.

Referring now to FIG. 2, it can be seen that each of the blades 20–24, blade 20 being shown for explanation purposes only, includes a fixed blade stem 44 and a removable cup extension 46. In the preferred embodiment of the invention, the propeller hub 14 and each of the blade stems 44 are integrally cast, such that the propeller hub 14 and the blade stems 44 form a single unitary structure. Each of the blade stems 44 extends axially outward from a blade root 48 to a blade tip, such as blade tip 26 in FIG. 2. Each of the blade stems 44 defines the leading edge 36 and terminates in an aft mounting edge 50 spaced axially rearward from leading edge 36.

Figure 3:
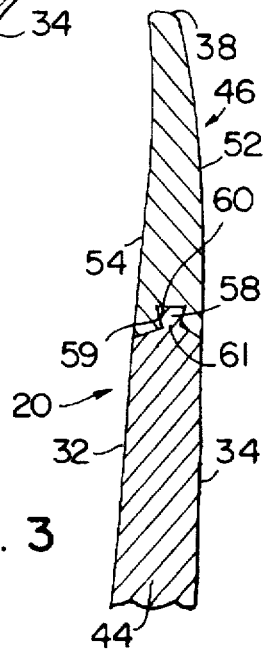
FIG. 3 is a cross section taken along line 3—3 of FIG. 1 showing the connection between the propeller blade stem and trailing edge cup extension.

The removable cup extensions 46 have a negative face surface 52, FIGS. 2 and 3, a positive face surface 54, a leading connecting edge 56 and define the trailing edge 38 of each propeller blade 20–24. As can be understood in both FIGS. 2 and 3, the leading connecting edge 56 of each cup extension 46 interacts with the aft mounting edge 50 contained on one of the propeller blade stems 44. The cup extension 46 is secured to the propeller blade stem 44 by an interference mechanical fit to prevent aft movement of the cup extension 46 when the propeller is rotated. In the preferred embodiment of the invention, the mounting edge 50 of the propeller blade stem 44 includes a projecting tongue 58, FIG. 3, which is received by a corresponding groove 60 formed in the connecting edge 56 of the cup extension 46. The propeller blade stems 44 must be constructed of an adequate thickness between the negative pressure side 34 and the positive pressure side 32 in order to allow the projecting tongue 58 to be formed thereon. Tongue 58 is tapered outward from fore to aft and includes an expanded aft end 59 which is wider than a neck portion 61. The groove 60 formed in the connecting edge 56 corresponds to the tapered tongue 58 and tapers to a narrower width as it extends forwardly. The sloping configuration of the tongue 58 prevents the cup extension 46 from becoming detached rearwardly from the blade stem 44. Although the invention has been described as including the stem 44 and the groove 60 on the cup extension 46, it is understood that the tongue and groove placement could be exchanged to provide the interference mechanical fit.

Figure 4:
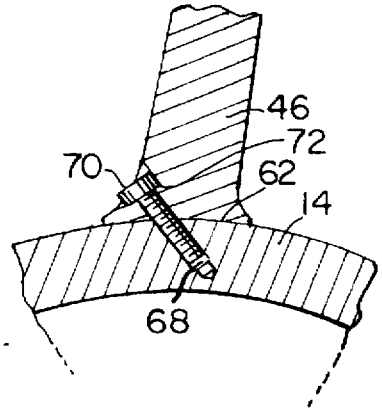
FIG. 4 is a sectional view taken along line 4—4 in FIG. 1 showing the connection between the propeller hub and the trailing edge cup extension.

When installing the cup extension 46 on the blade stem 44 after the propeller hub 14 and blade stem 44 are cast, the portion of tongue 58 nearest the blade tip 26 is first positioned within the groove 60. The cup extension 46 is then slid radially inwardly toward hub 14 along the mounting edge 50 from the outer blade tip 26 to the blade root 48. Once the inner edge 62 of the cup extension 46 contacts the propeller hub 14, the cup extension 46 is secured to the propeller hub 14 by any suitable connecting means, whether permanent or removable. In the preferred embodiment of the invention, a removable screw 64, FIG. 2, passes through a mounting aperture 66 contained in the cup extension 46 and is received in a corresponding internally threaded mounting bore 68, FIG. 4, in propeller hub 14. Once the screw 64 is tightened into place, a screw head 70 engages a screw seat 72 to securely hold the cup extension 46 in place during subsequent propeller operation.

Referring now to FIG. 3, it can be seen that the trailing edge 38 of the cup extension 46 is curled away from the boat and toward the positive pressure surface 32 of the blade stem 44. As can be understood in FIG. 3, the positive face surface 54 of the cup extension 46 is generally concave, while the negative face surface 52 is generally convex, causing the cupping of the trailing edge 38. The amount of cupping is measured by the distance the trailing edge 38 is displaced from a center line passing through the center of the blade stem 44. As previously discussed, cupping tends to reduce engine speed without lowering boat speed, as compared to a propeller having the same pitch without any cupping.

If the amount of cupping on propeller 12 is desired to be increased or decreased based on boat performance requirements, the propeller can be modified by simply removing the cup extensions 46 and replacing them with cup extensions 46 having a greater or a lesser degree of cupping. In the preferred embodiment, to remove the cup extension 46, screw 64 is removed and the cup extension 46 is slid along mounting edge 50 radially away from propeller hub 14 until the cup extension 46 is completely removed from blade stem 44. Once removed, a new cup extension 46 can be attached in the manner previously described. In this manner, design characteristics of a single propeller can be quickly and easily modified by selectively choosing a cup extension 46 having the desired amount of cupping. By using the propeller 12 incorporating the cup extensions 46 shown in the invention, the propeller technician no longer is required to physically hammer or sand the trailing edge of a cast propeller to increase or decrease the amount of cupping. Therefore, the propeller maintains a uniform trailing edge 38 which increases the performance characteristics of propeller 12.

In the preferred embodiment of the invention, the cup extension 46 is formed from the same material as the remainder of the propeller 12, such as stainless steel or aluminum. However, it is contemplated that the cup extension 46 could be formed of a dissimilar material from the remainder of the propeller 12, in order to modify specific operating characteristics of propeller 12 or reduce production costs.

In another feature of the invention, should the trailing edge 38 of any cup extension 46 be damaged during routine usage, the cup extension 46 can simply be removed and replaced. When a typical propeller is damaged either along the leading edge 36 or the trailing edge 38, a propeller technician is only able to smooth out the damage, and if the damage is too severe, the propeller needs to be completely replaced. Even if the propeller is repaired, any imperfection along the trailing edge 38 has an adverse effect on the propeller performance. With the present invention, if damage occurs to the trailing edge 33, the cup extensions 46 can be replaced and the propeller 12 returned to optimum performing condition.

It is recognized that various equivalents, alternatives and modifications are possible within the scope of the appended claims.

I claim:

1. A marine propeller comprising:

a propeller hub rotational about a rotation axis for propulsion in a forward direction therealong;

a plurality of propeller blade stems extending generally radially outward from the propeller hub from a blade root to a blade tip, each propeller blade stem having a leading edge and an aft mounting edge, each of the aft mounting edges having a projecting tongue tapered outwardly to a wider width as the tongue extends rearwardly, the tongue extending radially outwardly from the respective blade root to the respective blade tip;

a plurality of cup extensions each having a trailing edge and a leading connecting edge, each of the leading connecting edges having a groove tapered inwardly to a narrower width as it extends forwardly, the groove receiving the tongue to removably mount each cup extension on the respective propeller blade stem and prevent aft movement of each cup extension relative to the respective propeller blade stem, each of the cup extensions including an attachment hole for receiving an attachment member, each respective attachment member extending through each respective cup extension and into the propeller hub for securing each cup extension to the propeller hub.

2. A method of modifying an amount of cupping on a marine propeller, the method comprising the steps of:

providing a propeller hub having a plurality of propeller blade stems, the blade stems extending radially outward from the propeller hub, each blade stem having a leading edge and an aft mounting edge;

determining the desired amount of cupping for the propeller;

providing a plurality of cup extensions having the desired amount of cupping;

attaching the cup extensions to the mounting edges of the propeller blade stems; and securing the cup extensions to the propeller hub.

3. The method according to claim 2 further comprising providing the cup extensions with a leading connecting edge and a trailing edge, and attaching the cup extensions to the mounting edges of the propeller blade stems at the connecting edges of the cup extensions.

4. The method according to claim 3 further comprising attaching the cup extensions to the propeller blade stems by sliding the connecting edges of the cup extensions radially inwardly toward the propeller hub along the mounting edges of the propeller blade stems.

5. The method according to claim 4 further comprising providing an interference mechanical fit between the mounting edges of the propeller blade stems and the connecting edges of the cup extensions preventing aft movement of the cup extensions relative to the propeller blade stems after the radially inward sliding movement of the connecting edges of the cup extensions along the mounting edges of the propeller blade stems.

6. The method according to claim 5 further comprising attaching the cup extensions to the hub after radially sliding the connecting edges of the cup extensions along the mounting edges of the propeller blade stems to prevent radial outward movement of the connecting edges of the cup extensions along the mounting edges of the propeller blade stems.

7. A marine propeller comprising:

a propeller hub rotational about a rotation axis for propulsion in a forward direction therealong;

a plurality of propeller blade stems extending generally radially outward from the propeller hub from a blade root to a blade tip, each propeller blade stem having a leading edge and an aft mounting edge; and a plurality of cup extensions each having a leading connecting edge and a trailing edge, each respective one of the cup extensions being mounted to a respective one of the propeller blade stems at the connecting edge of the respective cup extension and the mounting edge of the respective propeller blade stem, each of the respective cup extensions including an attachment hole for receiving an attachment member, the attachment member extending through each respective cup extension and into the propeller hub for securing the respective cup extension to the propeller hub.

8. A method of modifying an amount of cupping on a marine propeller, the method comprising the steps of:

providing a propeller hub having a plurality of propeller blade stems, the blade stems extending radially outward from the propeller hub, each blade stem having a leading edge and an aft mounting edge;

determining the desired amount of cupping for the propeller;

providing a plurality of cup extensions having the desired amount of cupping, each cup extension having a leading connecting edge and a trailing edge;

attaching the cup extensions to the mounting edges of the propeller blade stems at the connecting edges of the cup extensions by sliding the connecting edges of the cup extensions radially inwardly toward the propeller hub along the mounting edges of the propeller blade stems;

providing an interference mechanical fit between the mounting edges of the propeller blade stems and the connecting edges of the cup extensions to prevent aft movement of the cup extensions relative to the propeller blade stems after the radially inward sliding movement of the connecting edges of the cup extension along the mounting edges of the propeller blade stems; and attaching the cup extensions to the hub after radially sliding the connecting edges of the cup extensions along the mounting edges of the propeller blade stems to prevent radially outward movement of the connecting edges of the cup extensions along the mounting edges of the propeller blade stems.

* * * * *